US007267729B2

(12) United States Patent
Chiba et al.

(10) Patent No.: US 7,267,729 B2
(45) Date of Patent: Sep. 11, 2007

(54) SOFT MAGNETIC LOW-CARBON STEEL EXCELLENT IN MACHINABILITY AND MAGNETIC CHARACTERISTIC, METHOD OF MANUFACTURING THE SAME AND METHOD OF MANUFACTURING SOFT MAGNETIC LOW-CARBON PART

(75) Inventors: Masamichi Chiba, Kobe (JP); Masato Kaiso, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 512 days.

(21) Appl. No.: 10/737,764

(22) Filed: Dec. 18, 2003

(65) Prior Publication Data

US 2005/0139289 A1 Jun. 30, 2005

(51) Int. Cl.
*H01F 1/147* (2006.01)

(52) U.S. Cl. ..... 148/306; 148/120

(58) Field of Classification Search ..... None
See application file for complete search history.

(56) References Cited

U.S. PATENT DOCUMENTS 6,635,361 B1 * 10/2003 Sugihara et al. ..... 428/667
2004/0007290 A1 * 1/2004 Sugihara et al. ..... 148/120
2005/0139289 A1 6/2005 Chiba et al.

FOREIGN PATENT DOCUMENTS

JP 7-90505 * 4/1995

OTHER PUBLICATIONS

U.S. Appl. No. 11/456,400, filed Jul. 10, 2006, Chiba.

* cited by examiner

*Primary Examiner*—John P. Sheehan
(74) *Attorney, Agent, or Firm*—Oblon, Spivak, McClelland, Maier & Neustadt, P.C.

(57) ABSTRACT

A soft magnetic low-carbon steel has a chemical composition having a C content of 0.05% by mass or below, Si content of 0.1% or below, a Mn content in the range of 0.10 to 0.50% by mass, a P content of 0.030% by mass or below, a S content in the range of 0.010 to 0.15% by mass, an Al content of 0.01% by mass or below, a N content of 0.005% by mass or below, and an 0 content of 0.02% by mass or below. In the soft magnetic low-carbon steel, Mn/S mass ratio is 3.0 or above, ferrite grain size is 100 μm or above, ferrite grains contain precipitated MnS grains of grain sizes of 0.2 μm or above in a density in the density range of 0.02 to 0.5 grains/$\mu^2$m and the precipitated MnS grains have a mean grain size in the range of 0.05 to 4 μm. The soft magnetic low-carbon steel is excellent in cold-rollability and machinability. Steel parts of the soft magnetic low-carbon steel having complicated shapes can be produced at a high yield.

5 Claims, 3 Drawing Sheets

(mass%)

| C | Si | Mn | P | S | Al | N | O |
|---|---|---|---|---|---|---|---|
| 0.004 | 0.006 | 0.23 | 0.008 | 0.035 | 0.003 | 0.0020 | 0.0028 |

SOFT MAGNETIC LOW-CARBON STEEL EXCELLENT IN MACHINABILITY AND MAGNETIC CHARACTERISTIC, METHOD OF MANUFACTURING THE SAME AND METHOD OF MANUFACTURING SOFT MAGNETIC LOW-CARBON PART

BACKGROUND OF THE INVENTION

1. Field of the Invention

The present invention relates to a soft magnetic low-carbon steel useful for forming iron cores for solenoids, relays and solenoid valves to be applied to various electric devices for automobiles, electric trains and ships, a method of manufacturing the soft magnetic low-carbon steel, and a method of manufacturing a soft magnetic low-carbon part of the soft magnetic low-carbon steel. More particularly, the present invention relates to a soft magnetic low-carbon steel excellent in cold forgeability, machinability and magnetic characteristic, and a method of manufacturing a soft magnetic low-carbon steel part of the soft magnetic low-carbon steel having an excellent magnetic characteristic.

2. Description of the Related Art

Component members of magnetic circuits included in electric devices for automobiles and such are required to have a low coercive force, in addition to a capability of being easily magnetized by a low-intensity external magnetic field, for the improvement of power consumption and response characteristic of the electric circuits. Thus, those component members of magnetic circuits are formed of soft magnetic materials so that the magnetic flux density in those component members changes in quick response to the change of an external magnetic field. Representative soft magnetic steels are very-low-carbon steels having a carbon content on the order of 0.01% by mass (hereinafter, content is expressed in percent by mass, unless otherwise specified). A soft magnetic steel part is manufactured by subjecting a steel billet of a very-low-carbon steel to hot rolling to obtain a steel sheet, and sequentially subjecting the steel sheet to lubrication, drawing, cold forging (or cold pressing), finish machining and magnetic annealing.

There is a tendency for the shape and construction of soft magnetic steel parts to become complicated to cope with the development of high-performance electric devices in the recent years. While on the one hand the very-low-carbon steel is excellent in cold press workability, the very-low-carbon steel is very liable to form flashes and burrs when a workpiece of the very-low-carbon steel is subjected to a shearing process or a drilling process. Consequently, a very-low-carbon steel part having a complicated shape is difficult to machine and cannot manufacture at high productivity.

Under such circumstances, some measures have been pro-posed to improve the machinability of soft magnetic steels. An invention disclosed in, for example, JP51-16363B relating to a method of improving the machinability of pure-steel soft magnetic material adds a low-melting metal, such as Pb or Bi in a proper content to the pure-steel soft magnetic material to improve the machinability of the pure-steel soft magnetic material and to extend the life of tools without deteriorating the magnetic characteristic of the pure-steel soft magnetic material. The principal object of this previously proposed invention, however, is to improve the life of tools, and the previously proposed invention is not necessarily satisfactory in effect of reducing the formation of burrs during machining. The element added to the soft magnetic material to improve the machinability of the soft magnetic material affects adversely to the magnetic characteristic of the soft magnetic material. Thus, the magnetic characteristic of the soft magnetic material containing such an additive element is JIS SUYB Class 2, at the most.

SUMMARY OF THE INVENTION

The present invention has been made in view of such problems and it is therefore an object of the present invention to provide a soft magnetic steel excellent in machinability and cold press-workability, capable of forming steel parts having complicated shapes and of being processed at a high yield, and to provide a method of manufacturing soft magnetic steel parts of the soft magnetic steel having excellent magnetic characteristic.

According to one aspect of the present invention, a soft magnetic low-carbon steel has a chemical composition having a C content of 0.05% by mass or below, a Si content of 0.1% by mass or below, a Mn content in the range of 0.10 to 0.50% by mass, a P content of 0.030% by mass or below, a S content in the range of 0.010 to 0.15% by mass, an Al content of 0.01% by mass or below, a N content of 0.005% by mass or below, and an O content of 0.02% by mass or below; wherein Mn/S mass ratio is 3.0 or above, ferrite grain size is 100 μm or above, ferrite grains contain precipitated MnS grains of grain sizes of 0.2 μm or above in a density in the density range of 0.02 to 0.5 grains/$\mu m^2$, and the precipitated MnS grains have a mean grain size in the range of 0.05 to 4 μm.

Addition of Bi in a Bi content in the range of 0.005 to 0.05% and/or Pb in a Pb content in the range of 0.01 to 0.1% to the soft magnetic low-carbon steel further improves the machinability without deteriorating the magnetic characteristic. Addition of B in a B content in the range of 0.0005 to 0.005% to the soft magnetic low-carbon steel further improves the magnetic characteristic by fixating N in BN.

A method of manufacturing a soft magnetic low-carbon steel excellent in magnetic characteristic and machinability comprises the steps of: heating a soft magnetic low-carbon steel having a chemical composition having a C content of 0.05% by mass or below, a Si content of 0.1% bay mass or below, a Mn content in the range of 0.10 to 0.50% by mass, a P content of 0.030% by mass or below, a S content in the range of 0.010 to 0.15% by mass, an Al content of 0.01% by mass or below, a N content of 0.005% by mass or below, and an O content of 0.02% by mass or below at a temperature in the range of 1000° C. to 1200° C. and hot-rolling the heated soft magnetic low-carbon steel in a steel sheet; and finish-rolling the hot-rolled steel sheet at a finishing temperature of 850° C. or above, and cooling the finish-rolled steel sheet in the range of 800° C. to 500° C. at a mean cooling rate in the range of 0.5 to 10° C./s.

A part of a soft magnetic low-carbon steel can be obtained by forming a steel workpiece subjecting the soft magnetic low-carbon steel thus processed cold forging and machining, and the annealing the workpiece at a temperature in the range of 850° C. to 950° C. for 3 hr or longer. The steel workpiece of the soft magnetic low-carbon steel thus annealed has excellent magnetic characteristic and machinability.

The soft magnetic low-carbon steel of the present invention can be easily processed by cold forging and machining. Soft magnetic parts formed of the soft magnetic low-carbon steel annealed by magnetic annealing have magnetic characteristics meeting requirements specified in JIS SUYB Class 1. The present invention provides the material suitable for forming such soft magnetic parts, and a method of manufacturing the same material.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

The inventors of the present invention found through studies of the structure of steels and precipitates made to improve the machinability and magnetic characteristic of soft magnetic low-carbon steels that a steel containing fine MnS grains dispersed in ferrite structure has a satisfactory magnetic characteristic, machinability, and a property capable of preventing the formation of burrs by machining (hereinafter, referred to as "antiburring property"), and have made the present invention on the basis of the findings obtained through the studies.

The magnetic characteristic of a soft magnetic low-carbon steel is related with the amount of energy for fixating magnetic flux in the soft magnetic low-carbon steel, and is dependent on ferrite grain size, and the magnetic property and distribution of precipitates. Generally, the response of a steel to an external magnetic field, i.e., magnetic characteristic, deteriorates when ferrite structure has voids or contains paramagnetic precipitates because magnetic flux penetrating the steel is bound by the voids or the paramagnetic precipitates.

The direction of magnetic moment of diamagnetic precipitates, such as MnS grains, is different from that of an external magnetic field. Magnetic flux penetrates a material, evading the precipitates, and hence the amount of energy for binding the magnetic flux is small. The magnitude of the magnetic moment of diamagnetic grains is small as compared with the magnetic moment of a ferrite matrix. Therefore, the diamagnetic grains do not deteriorate the magnetic characteristic of the steel. However, if MnS grains grow large or precipitate by grain boundary reaction, the amount of energy for binding magnetic flux increases and, consequently, the magnetic characteristic of the steel is deteriorated.

Figure 1:
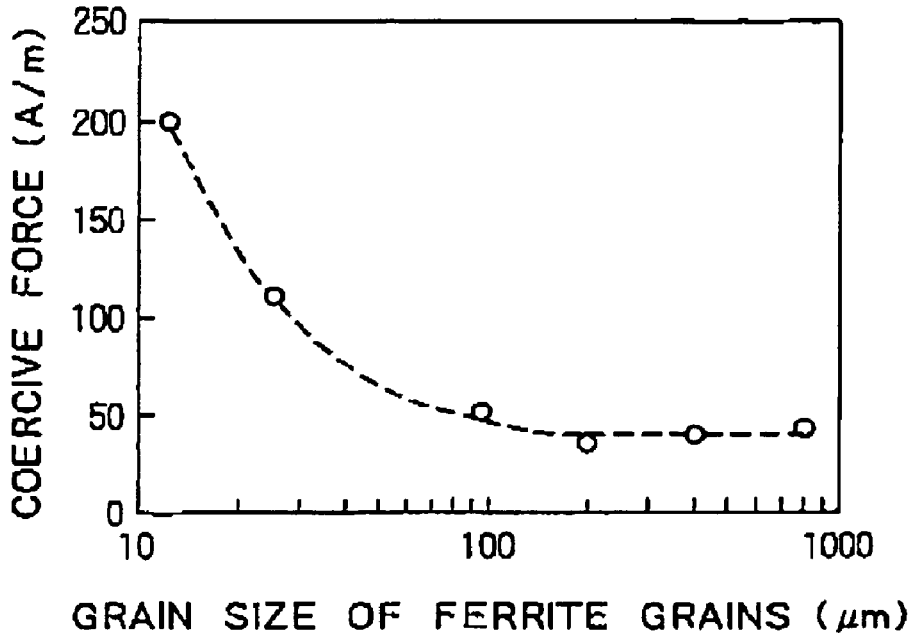
FIG. 1 is a graph showing the dependence of the coercive force of a low-carbon steel on ferrite grain size.
Figure 2:
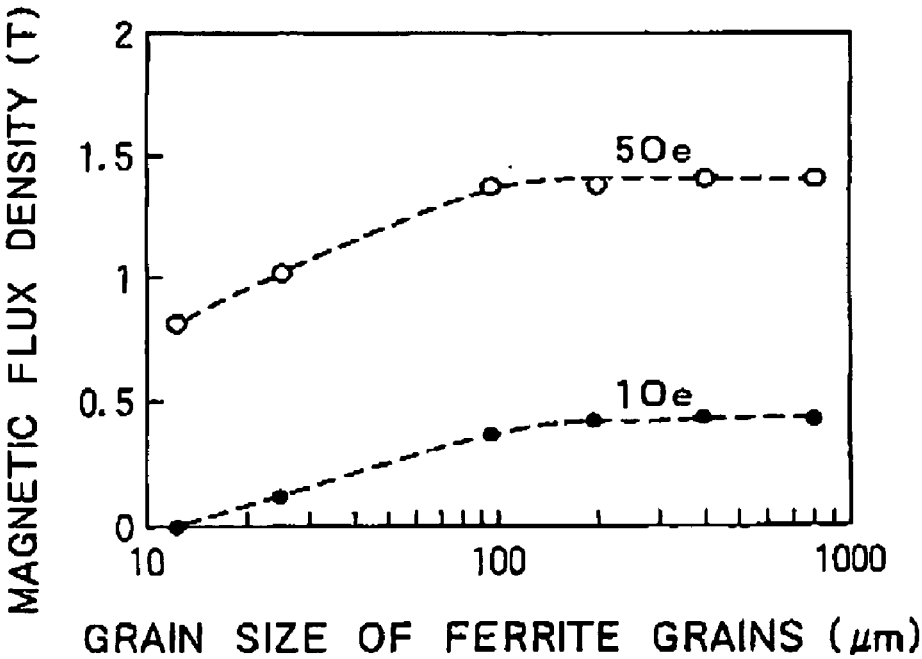
FIG. 2 is a graph showing the dependence of magnetic flux density in a low-carbon steel on ferrite grain size.
Figure 3:
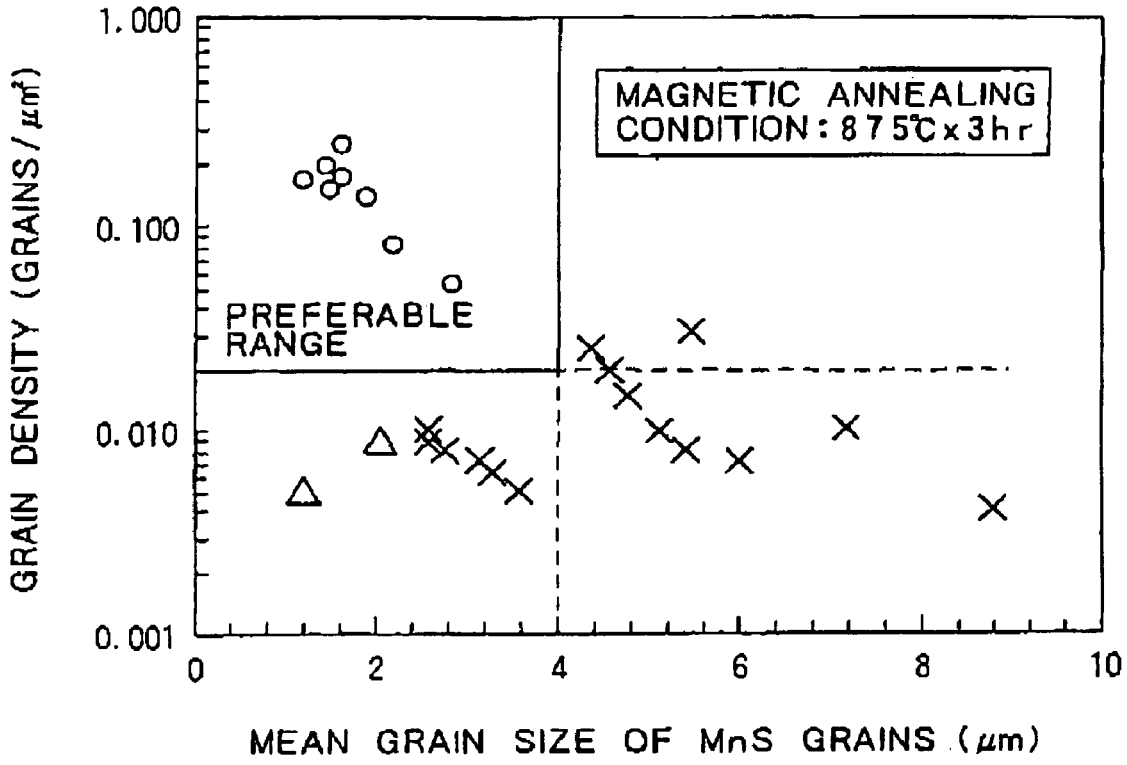
FIG. 3 is a graph of assistance in explaining the effect of the mean grain size and the number (density) of MnS grains precipitated in ferrite grains on the magnetic characteristic and machinability (property capable of preventing the formation of burrs) of a low-carbon steel.

The inventors of the present invention made further studies on the basis of those findings and found that the magnetic characteristic of a low-carbon, steel having a carbon content of 0.05% or below can be remarkably improved by growing ferrite grains in grain sizes of 100 μm or above to reduce the area of grain boundaries as shown in FIGS. 1 and 2. It was found also that it is effective in improving both the magnetic characteristic and machinability of the low-carbon steel to increase the number of MnS grains of grain sizes (mean value of the largest diameter and the smallest diameter in a gain) of 0.2 μm or above precipitated between the ferrite grains as shown in FIG. 3, and that a low-carbon steel containing MnS grains having mean grain size in the range of 0.05 to 4 μm in a density of 0.02 grains/$\mu m^2$ has a high magnetic characteristic and a high machinability (antiburring property) intended by the present invention. In FIG. 3, circles, triangles and crosses indicate evaluation criteria shown in Table 1.

In Table 1, "SUYB" represents a standard of magnetic characteristic specified in JIS C2503. Practically, materials having magnetic characteristics superior to a magnetic characteristic corresponding to SUYB Class 1 are applicable to forming parts for magnetic circuits included in electric devices, and those having magnetic characteristics superior to a magnetic characteristic corresponding to SUYB Class 2 are applicable to simple relays and switches. Parts corresponding to SUYB Class 1 are superior to those corresponding to SUYB Class 2, and parts corresponding to SUYB Class 0 are superior to those corresponding to SUYB Class 1 in effect of forming parts in compact construction (lightweight construction), in effect of enhancing response speed and in effect of power consumption. Thus, the further improvement of the magnetic characteristic of the parts for the same purposes is desired. Fine MnS grains of grain sizes below 0.2 μm do not have significant adverse influence on magnetic characteristic, but have insignificant effect in improving machinability.

TABLE 1

| | | Magnetic characteristic | |
|---|---|---|---|
| | | SUYB-1 Class | SUYB-2 Class |
| Burrs | Below 1 mm | ○ | X |
| | 1 mm or above | Δ | X |

Thus, the pricipal point o the present invention is controlling the density in the ferrite structure of a low-carbon steel and the grain size of comparatively coarse MnS grains precipitated in the ferrite structure. It is desirable to control the chemical composition of the low-carbon steel, and conditions for rolling and annealing the low-steel carbon in addition to controlling the density and grain size of MnS grains to ensure that the low-carbon steel has the aforesaid desired characteristics.

Limiting conditions for the chemical composition of the low-carbon steel according to the present invention will be explained.

Carbon (C) Content: 0.5% or Below

Carbon is a basic element that dominates the strength and the ductility of steels. The strength of steels decreases and the ductility of steels increases with the decrease of the C content. A low C content is preferable because C dissolved in steels causes age hardening and affects the magnetic characteristic of steels adversely. To provide steels having a magnetic characteristic meeting conditions specified in JIS SUYB Class 1, the C content must be 0.05% or below, more preferably, 0.01% or below.

Silicon (Si) Content: 0.1% or Below Excluding 0%

Silicon functions as a deoxidizer when steels are melted, and improves the magnetic characteristics of steels. An excessive Si content deteriorates cold forgeability. Therefore, the Si content of steels satisfactory in cold forgeability is 0.1% or below, more preferably, 0.05% or below.

Manganese (Mn) Content: 0.1 to 0.5%

Manganese functions as an effective deoxidizer, and combines with sulfur (S) contained in steels and precipitates in fine and dispersed MnS grains. Fine MnS grains serve as a chip breaker and improve machinability of steels. The Mn content of steels must be 0.1% or above to make the aforesaid characteristics of Mn effective. However, an excessive Mn content precipitates coarse MnS grains and deteriorates the magnetic characteristic. Thus, the present invention sets an upper limit of 0.5% to Mn content. The atomic ratio Mn/S must be 3.0 or above to prevent the embrittlement of steels by free S contained in steels and to provide steels having practically acceptable strength. More preferably, the atomic ratio Mn/S is in the range of 5 to 15.

Phosphorus (P) Content: 0.03% or Below Excluding 0%

Phosphorus contained in steels is a detrimental element that cause grain boundary segregation and cause a bad effect on cold forgeability and magnetic characteristic. Therefore, P content must be 0.030% or below, more preferably, 0.010% or below. When the P content of steels is below such a limit, steels secure excellent cold forgeability and magnetic characteristic.

Sulfur (S) Content: 0.01 to 1.5%

Sulfur combines with Mn to produce MnS grains in steels. Stress concentration occurs in MnS grains during machining, which improves the machinability of steels. To make such an effect of S effective, S content must be 0.0% or above. However, an excessive S content deteriorates cold forgeability significantly and hence S content must be 0.15% or below. Thus, a preferable S content is in the range of 0.05 to 0.10% .

Aluminum (Al) Content: 0.01% or Below

Aluminum fixates dissolved nitrogen (N) in AlN and reduces grain size. Excessive increase in grain boundaries deteriorates magnetic characteristic, and hence Al content must be 0.01% or below. A preferable upper limit to Al content is 0.005% to secure excellent magnetic characteristic.

Nitrogen (N) Content: 0.005% or Below Excluding 0%

As mentioned above, N combines with Al to produce AN grains that affect adversely to magnetic characteristic. Dissolved N not combined with Al deteriorates magnetic characteristic. Although N content must be reduced to the least possible extent, the present invention set an upper limit of 0.005% to N content, taking into consideration the practical condition of iron making processes, and a N content having practically negligible detrimental effect.

Oxygen (O) Content: 0.02% or Below Excluding 0%

Oxygen dissolves scarcely in steels at ordinary temperatures, and combines with Al and Si to produce hard oxides having a significant effect of deteriorating the magnetic characteristic of steels. Therefore O content must be reduced to the least possible extent and must be 0.02% at the highest. Preferably, O content is 0.005% or below, more preferably, 0.002% or below.

Bismuth (Bi) Content: 0.005 to 0.05% and/or

Lead (Pb) Content: 0.01 to 0.1%

Bismuth and lead are elements effective in improving machinability. Addition of either Bi or Pb, or both Bi and Pb to steels improves the machinability of steels remarkably. The effect of Bi is effective when Bi content is 0.005% or above, and that of Pb is effective when Pb content is 0.01% or above. However excessive Bi content and Pb content affects adversely to magnetic characteristic. Therefore, Bi content must be 0.05% or below and Pb content must be 0.1% or below. A preferable Bi content is in the range of 0.01 to 0.03% , and a preferable Pb content is in the range of 0.02 to 0.05% .

Boron (B) Content: 0.0005 to 0.005%

Boron fixates dissolved N that affects adversely to magnetic characteristic in BN grains. Moreover, the affinity of B to N is higher than that of Al to N. Thus, B suppresses the precipitation of AlN that reduces grain size. Such an effect of B is effective when B content is 0.0005% or above. However, an excessive amount of BN grains in steels deteriorates the magnetic characteristic of steels, and hence B content must be 0.005% or below. Thus, a preferable B content is in the range of 0.001 to 0.003% .

In manufacturing the soft magnetic low-carbon steel of the present invention, a steel billet of a chemical composition meeting the foregoing requirements may be melted and cast by the usual melting and casting processes. However, to obtain a soft magnetic low-carbon steel excellent in cold forgeability, machinability and formability, and having a magnetic characteristic of a level corresponding to that of JIS SUYB Class 1 after magnetic annealing, it is very effective to subject a steel sheet of a chemical composition meeting the foregoing requirements to hot rolling at a temperature in the range of 1000° C. to 1150° C., subject the hot-rolled steel sheet to finish rolling at a temperature of 850° C. or above, and cool the rolled steel sheet in the range of 800° C. to 500° C. at a mean cooling rate in the range of 0.5 to 10° C./s. Bases for determining those processing conditions will be explained.

Hot-rolling Temperature: 1000° C. to 120° C.

It is desirable to heat a steel at the highest possible temperature to dissolve the alloy contents of the steel completely in the matrix. On the other hand, it is preferable that a steel sheet is heated for hot rolling at a comparatively low rolling temperature, at which MnS contained in the steel sheet has a low deformability, to divide MnS grains into smaller MnS grains by rolling. If the rolling temperature is excessively low, it is possible that different phases are produced locally and cracks develop in the steel sheet during rolling, and load on rolling rolls increases and productivity is reduced. Thus, it is preferable that the rolling temperature is 1000° C. or above, more preferably, 1100° C. or above. If the steel sheet is heated at an excessively high rolling temperature exceeding 1200° C., ferrite grains grow excessively, and the formability and cold-rollability of the steel sheet deteriorate. Thus, it is preferable that the rolling temperature is about 1200° C. or below.

Finish-Rolling Temperature: 850° C. or Above

Grain size and grain density of MnS grains are distributed in wide ranges, respectively, if the finish-rolling temperature is excessively low. It is desirable that the finish-rolling temperature is 850° C. or above, more desirably, 900° C. or above to precipitate fine MnS grains uniformly in the matrix.

Cooling Rate After Hot Rolling: 0.5 to 10° C./s in the Range of 800° C. to 500° C.

Atomic vacancies increases when a steel is cooled at an excessively high cooling rate after hot rolling, and the steel is unable to secure a satisfactory magnetic characteristic even after being treated by magnetic annealing. It is preferable to cool the steel at a cooling rate of 10° C./s or below in the range of 800° C. to 500° C. to secure a magnetic characteristic of a level intended by the present invention. An excessively low cooling rate will reduce productivity, and forms large MnS grains, and hence the cooling rate must be 0.5° C./s or above. A preferable cooling rate is in the range of 1 to 5° C./s. The steel must be cooled at such a cooling rate in the range of 800° C. to 500° C. because phase transformation to produce a ferrite phase does not proceed and hence the metal structure is affected scarcely by cooling at temperatures exceeding 800° C., and phase transformation into the ferrite phase and the precipitation of MnS is substantially completed at temperatures below 500° C. Thus, the object of determination of the cooling rate cannot be achieved at temperatures outside the range of 800° C. to 500° C.

In manufacturing a magnetic part of the soft magnetic low-carbon steel, a sheet of the soft magnetic low-carbon steel is subjected to a cold forging process to form a workpiece, the workpiece is machined and the machined workpiece is subjected to a magnetic annealing process to obtain the magnetic part. To provides the magnetic part with an excellent magnetic characteristic utilizing the merits of the soft magnetic low-carbon steel, it is desirable to carry our the magnetic annealing process following the cold forging and the machining process at a temperature in the range of 850° C. to 950° C. for 3 hr or longer.

Figure 4:
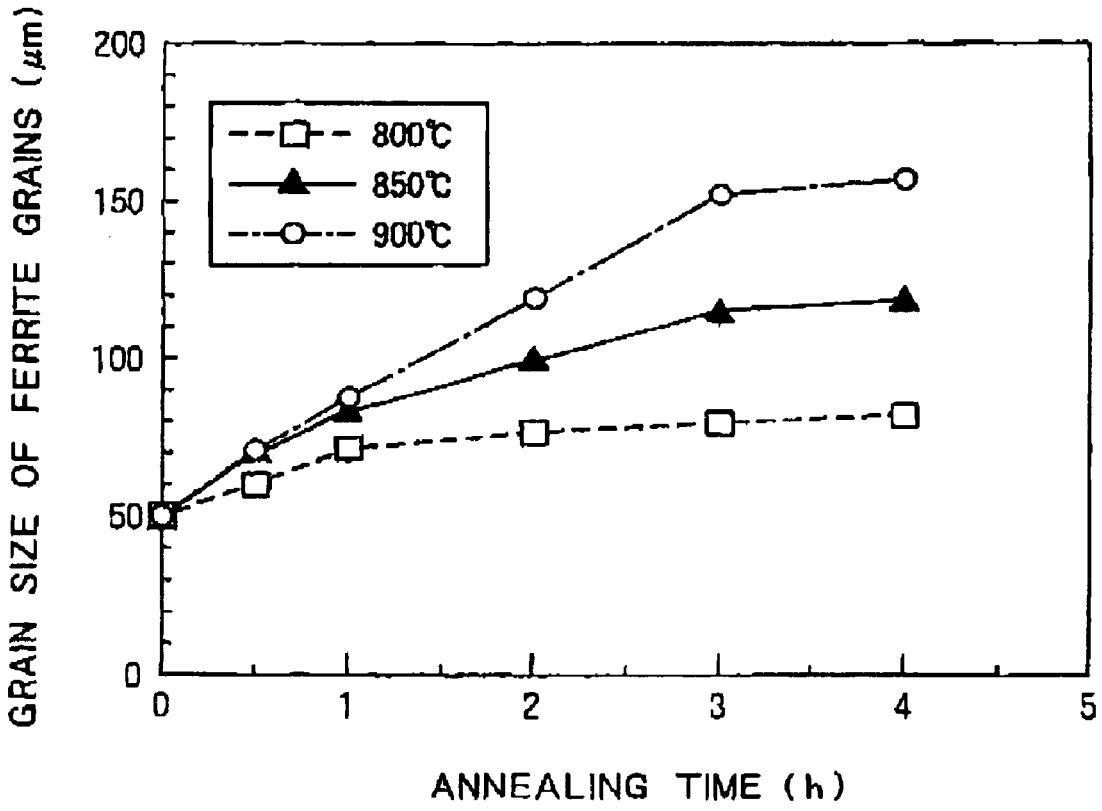
FIG. 4 is a graph showing the relation between ferrite grain size of an annealed low-carbon steel and annealing time for magnetic annealing temperatures in the range of 800° C. to 950° C.

FIG. 4 is a graph showing the effect of annealing temperature in the range of 800° C. to 950° C. and annealing time in the range of 30 min to 4 hr on ferrite grain size of a soft magnetic low-carbon steel. As obvious from FIG. 4, optimum ferrite grains intended by the present invention cannot be formed in a practical annealing time when the annealing temperature is below 850° C., and coarse MnS grains are formed in the vicinity of ferrite grain boundaries to obstruct the improvement of magnetic characteristic when the annealing temperature is higher than 950° C. Thus, a preferable annealing temperature for magnetic annealing is in the range of 875° C. to 900° C. Sufficiently large ferrite grains cannot be formed even if magnetic annealing is carried out at a high annealing temperature when the annealing time is shorter than 2 hr. Thus, it is desirable that the annealing temperature is 2.5 hr at the shortest, more desirably, 3 hr or longer.

EXAMPLES

The constitution and effect of the present invention will be specifically described in connection with examples, which, however, do not place any restrictions on the present invention.

Billets of test steels respectively having chemical compositions shown in Table 2 were cast. Wires of 20 mm in diameter were manufactured by subjecting the billets to hot rolling under rolling conditions shown in Table 3. Then, the wires were subjected to a wire drawing process at a reduction of area of 10% to obtain 19 mm diameter test wires. Sections of the test wires were observed to determine the metal structures of the test steels forming the wires, and the mean grain size and density of MnS grains. The magnetic characteristics of the test wires processed by the magnetic annealing were measured. Table 3 shows the structures and magnetic characteristics of the test wires. The structures were determined and the grain sizes were measured by the following methods.

Test wires were stuffed in a support, the exposed sections of the wires were polished, and the polished surfaces of the test wires were immersed in an alcohol solution of picric acid for 15 to 30 s for corroding. and the sections of the test wires were observed by a scanning electron microscope (SEM). The structure of a part at D/4 (D is the diameter of the test wire) of the section of the test wire were magnified at a magnification in the range of 100× to 400× and ten photographs of ten fields of the section of the test wire were taken. The metal structure and grain sizes of the steel forming the test wires were determined through the examination of the photographs. The mean grain sizes and densities of MnS grains of grain sizes not smaller than 0.2 μm precipitated in the ferrite structure were determined through the analysis of photographs taken at magnifications in the range of 100× to 3000× using an image analyzer. The number of samples of each test wire was ten.

A test ring of 18 mm in outside diameter and 10 mm in inside diameter was formed by winding each test wire, the test ring was subjected to magnetic annealing, and a magnetic field creating coil and a magnetic flux measuring coil were wound round the test ring. The magnetic characteristic of the test wire was determined through the analysis of a magnetization curve (B-H curve) obtained through measurement by an automatic magnetization measuring apparatus.

Test pieces of 20 mm in diameter and 20 mm in thickness for testing machinability (antiburring property) were made by cutting the rolled steel sheets of the test steels. An 8 mm diameter through hole was formed in each test piece by feeding a drill at a feed rate of 0.2 mm/rev. The machinability of the test piece was evaluated in terms of the height of burrs formed when the 8 mm diameter through hole was formed in the test piece. Data on the height of burrs was obtained by measuring burrs at six circumferential positions spaced at angular intervals of 60° on five samples of each test piece, and the machinability of the test piece was represented by the mean of the measured data.

TABLE 2

| | | C | Si | Mn | P | S | Al | N | O | Bi | Pb | B | Mn/S |
|---|---|---|---|---|---|---|---|---|---|---|---|---|---|
| Examples | 1 | 0.005 | 0.006 | 0.10 | 0.008 | 0.030 | 0.003 | 0.0020 | 0.0030 | — | — | — | 3.3 |
| | 2 | 0.004 | 0.002 | 0.10 | 0.007 | 0.020 | 0.003 | 0.0021 | 0.0032 | — | — | — | 5.0 |
| | 3 | 0.005 | 0.007 | 0.24 | 0.008 | 0.020 | 0.003 | 0.0020 | 0.0027 | — | — | — | 12.0 |
| | 4 | 0.004 | 0.006 | 0.23 | 0.008 | 0.035 | 0.003 | 0.0020 | 0.0028 | — | — | — | 6.6 |
| | 5 | 0.004 | 0.006 | 0.41 | 0.008 | 0.070 | 0.003 | 0.0020 | 0.0028 | — | — | — | 5.9 |
| | 6 | 0.003 | 0.004 | 0.21 | 0.007 | 0.032 | 0.002 | 0.0020 | 0.0028 | 0.030 | — | — | 6.6 |
| | 7 | 0.004 | 0.005 | 0.23 | 0.006 | 0.035 | 0.002 | 0.0017 | 0.0025 | — | 0.05 | — | 6.6 |
| | 8 | 0.004 | 0.004 | 0.24 | 0.007 | 0.030 | 0.003 | 0.0020 | 0.0028 | — | — | 0.02 | 8.0 |
| Comparative Examples | 1 | 0.008 | 0.008 | 0.15 | 0.007 | 0.075 | 0.003 | 0.0020 | 0.0029 | — | — | — | 2.0 |
| | 2 | 0.074 | 0.008 | 0.25 | 0.008 | 0.034 | 0.004 | 0.0020 | 0.0032 | — | — | — | 7.4 |
| | 3 | 0.150 | 0.008 | 0.25 | 0.008 | 0.029 | 0.004 | 0.0021 | 0.0030 | — | — | — | 8.6 |
| | 4 | 0.005 | 0.050 | 0.05 | 0.008 | 0.015 | 0.004 | 0.0019 | 0.0033 | — | — | — | 3.3 |
| | 5 | 0.004 | 0.050 | 0.55 | 0.008 | 0.015 | 0.003 | 0.0022 | 0.0030 | — | — | — | 36.7 |
| | 6 | 0.005 | 0.008 | 0.25 | 0.025 | 0.030 | 0.004 | 0.0020 | 0.0032 | — | — | — | 8.3 |
| | 7 | 0.005 | 0.008 | 0.20 | 0.008 | 0.008 | 0.003 | 0.0017 | 0.0030 | — | — | — | 25.0 |
| | 8 | 0.005 | 0.008 | 0.46 | 0.008 | 0.200 | 0.040 | 0.0023 | 0.0036 | — | — | — | 2.3 |
| | 9 | 0.005 | 0.008 | 0.50 | 0.008 | 0.270 | 0.003 | 0.0022 | 0.0033 | — | — | — | 1.9 |
| | 10 | 0.005 | 0.008 | 0.25 | 0.008 | 0.025 | 0.040 | 0.0020 | 0.0029 | — | — | — | 10.0 |
| | 11 | 0.005 | 0.008 | 0.25 | 0.008 | 0.028 | 0.003 | 0.0140 | 0.0025 | — | — | — | 8.9 |
| | 12 | 0.005 | 0.008 | 0.25 | 0.008 | 0.032 | 0.003 | 0.0020 | 0.0280 | — | — | — | 7.8 |
| | 13 | 0.004 | 0.006 | 0.24 | 0.007 | 0.032 | 0.002 | 0.0018 | 0.0019 | 0.100 | — | — | 7.5 |
| | 14 | 0.005 | 0.004 | 0.23 | 0.008 | 0.027 | 0.004 | 0.0024 | 0.0024 | — | 0.40 | — | 8.5 |
| | 15 | 0.003 | 0.004 | 0.21 | 0.008 | 0.034 | 0.003 | 0.0022 | 0.0026 | — | — | 0.0150 | 6.2 |

TABLE 3

| Sample No. | Steels | | Heating temperature (° C.) | Finish-rolling temperature (° C.) | Cooling rate (° C/s) | MnS Mean grain size (μm) | MnS 'Grain density (Grains/μm$^2$) | Conditions for magnetic annealing Temperature (° C.) | Conditions for magnetic annealing Time (h) | Ferite grain size (μm) | Magnetic flux density (T) Intensity of magnetic field (Oe) 2 | 3 | 5 | 25 | Coercive force (A/m) | Height of burrs (mm) | Remarks |
|---|---|---|---|---|---|---|---|---|---|---|---|---|---|---|---|---|---|
| 1 | Examples | 1 | 1050 | 885 | 1.0 | 1.2 | 0.170 | 900 | 3 | 112 | 1.10 | 1.28 | 1.43 | 1.61 | 52 | 0.95 | |
| 2 | | 2 | 1050 | 875 | 1.2 | 1.2 | 0.150 | 800 | 3 | 73 | 0.76 | 0.98 | 1.20 | 1.59 | 80 | 0.93 | |
| 3 | | | 1050 | 875 | 1.2 | 1.3 | 0.170 | 875 | 3 | 120 | 1.11 | 1.30 | 1.48 | 1.69 | 54 | 0.91 | |
| 4 | | | 1120 | 870 | 1.4 | 2.2 | 0.080 | 875 | 3 | 118 | 1.05 | 1.24 | 1.46 | 1.62 | 57 | 0.87 | |
| 5 | | | 1070 | 875 | 1.2 | 1.3 | 0.180 | 900 | 3 | 151 | 1.10 | 1.30 | 1.50 | 1.62 | 54 | 0.85 | |
| 6 | | | | | | | | 900 | 1 | 81 | 0.84 | 1.15 | 1.32 | 1.64 | 82 | | |
| 7 | | | 1070 | 870 | 8.0 | 2.7 | 0.200 | 900 | 3 | 109 | 1.03 | 1.27 | 1.51 | 1.62 | 60 | 0.88 | |
| 8 | | 3 | 1080 | 860 | 1.1 | 1.4 | 0.200 | 875 | 3 | 131 | 1.05 | 1.28 | 1.50 | 1.67 | 50 | 0.81 | |
| 9 | | 4 | 1080 | 875 | 1.0 | 1.5 | 0.150 | 875 | 3 | 121 | 1.04 | 1.20 | 1.36 | 1.62 | 58 | 0.77 | |
| 10 | | 5 | 1050 | 880 | 1.2 | 1.6 | 0.250 | 875 | 3 | 125 | 1.03 | 1.20 | 1.36 | 1.62 | 49 | 0.72 | |
| 11 | | 6 | 1060 | 875 | 1.2 | 1.9 | 0.140 | 875 | 3 | 119 | 1.02 | 1.25 | 1.47 | 1.65 | 51 | 0.78 | |
| 12 | | 7 | 1050 | 875 | 1.3 | 1.6 | 0.180 | 875 | 3 | 107 | 1.01 | 1.18 | 1.44 | 1.63 | 55 | 0.76 | |
| 13 | | 8 | 1060 | 860 | 1.3 | 2.9 | 0.050 | 875 | 3 | 119 | 1.02 | 1.26 | 1.45 | 1.63 | 48 | 0.80 | |
| 14 | Comparative examples | 1 | 1060 | 860 | 1.3 | 2.7 | 0.130 | 875 | 3 | 74 | 0.62 | 0.74 | 0.96 | 1.54 | 78 | 0.96 | Cracks developed during wire drawing |
| 15 | | 2 | 1020 | 875 | 1.2 | 4.4 | 0.026 | 875 | 3 | 43 | 0.22 | 0.36 | 0.72 | 1.55 | 95 | 0.84 | |
| 16 | | | 1080 | 875 | 1.2 | 4.8 | 0.015 | 875 | 3 | 45 | 0.24 | 0.38 | 0.75 | 1.56 | 95 | 0.83 | |
| 17 | | | 1120 | 875 | 1.3 | 5.2 | 0.010 | 875 | 3 | 47 | 0.21 | 0.36 | 0.71 | 1.54 | 95 | 0.86 | |
| 18 | | | 1120 | 875 | 7.0 | 6.1 | 0.007 | 875 | 3 | 42 | 0.19 | 0.34 | 0.67 | 1.52 | 103 | 0.81 | |
| 19 | | 3 | 1050 | 860 | 1.0 | 7.2 | 0.010 | 875 | 3 | 25 | 0.16 | 0.28 | 0.64 | 1.46 | 111 | 0.79 | |
| 20 | | 4 | 1040 | 865 | 1.2 | 1.2 | 0.005 | 875 | 3 | 100 | 1.03 | 1.25 | 1.48 | 1.62 | 55 | 1.80 | |
| 21 | | 5 | 1025 | 875 | 1.3 | 8.8 | 0.004 | 875 | 3 | 93 | 0.96 | 1.1 | 1.25 | 1.58 | 87 | 1.30 | |
| 22 | | 6 | 1070 | 870 | 1.2 | 5.5 | 0.008 | 875 | 3 | 81 | 0.83 | 0.96 | 1.2 | 1.54 | 95 | 0.87 | |
| 23 | | 7 | 1050 | 860 | 1.2 | 2.1 | 0.009 | 875 | 3 | 119 | 1.06 | 1.32 | 1.52 | 1.61 | 55 | 3.10 | |
| 24 | | 8 | 1060 | 860 | 1.3 | 4.6 | 0.020 | 875 | 3 | 53 | 0.42 | 0.74 | 0.84 | 1.54 | 103 | 0.81 | |
| 25 | | 9 | 1050 | 865 | 1.2 | 5.5 | 0.030 | 875 | 3 | 39 | 0.18 | 0.32 | 0.62 | 1.46 | 119 | 0.76 | Cracks developed during wire drawing |
| 26 | | 10 | 1040 | 865 | 1.2 | 2.8 | 0.008 | 875 | 3 | 24 | 0.15 | 0.28 | 0.67 | 1.5 | 198 | 0.95 | |
| 27 | | 11 | 1050 | 870 | 1.0 | 2.6 | 0.010 | 875 | 3 | 71 | 0.54 | 0.68 | 0.83 | 1.62 | 69 | 1.10 | |
| 28 | | 12 | 1060 | 875 | 1.2 | 2.6 | 0.009 | 875 | 3 | 59 | 0.44 | 0.53 | 0.76 | 1.52 | 111 | 0.89 | |
| 29 | | 13 | 1050 | 865 | 1.3 | 3.2 | 0.007 | 875 | 3 | 84 | 0.65 | 0.76 | 0.86 | 1.6 | 87 | 0.82 | |
| 30 | | 14 | 1040 | 870 | 1.2 | 3.3 | 0.006 | 875 | 3 | 84 | 0.54 | 0.68 | 0.83 | 1.58 | 103 | 0.81 | |
| 31 | | 15 | 1040 | 870 | 1.2 | 3.6 | 0.005 | 875 | 3 | 71 | 0.51 | 0.68 | 0.82 | 1.57 | 111 | 0.84 | |

*Number of MnS grains of grain sizes not smaller than 0.2 μm in 1 μm$^2$

The following facts are known from Tables 2 and 3. Test steels Nos. 1, 3 to 5 and 8 to 13 are core materials meeting the requirements of the present invention, formed under manufacturing conditions specified by the present invention, and has magnetic characteristics exceeding those corresponding to JIS SUYB Class 1 and excellent machinability. Test steels Nos. 2, 6, 7 and 14 to 31 have chemical compositions not meeting the requirements of the present invention or are produced under manufacturing conditions not meeting the requirements of the present invention. Cracks developed in the test steels Nos. 2, 6, 7 and 14 to 31 during wire drawing. The test steels Nos. 2, 6, 7 and 14 to 31 have magnetic characteristics on a level below that corresponding to JIS SUYB Class 1, and are unsatisfactory in antiburring property.

Although the chemical compositions of test steels Nos. 2, 6 and 7 meet the requirements of the present invention, the manufacturing conditions for producing those test steels do not meet the requirements of the present invention. It is considered that large MnS grains were formed, many atomic vacancies were formed in the matrix, magnetic annealing could not achieve satisfactory recrystallization because the test steel No. 7 was cooled at an excessively high cooling rate after rolling, the structure had a large grain boundary area that deteriorated magnetic characteristic. Test steels Nos. 2 and 6 are not satisfactorily crystallized due to inappropriate conditions for magnetic annealing, have structure having a large grain boundary area, and hence are unsatisfactory in magnetic characteristic.

A test steel No. 14 has an atomic ratio Mn/S less than 3.0, is embrittled due to the segregation of S. Cracks developed in the steel No. 14 during wire drawing. It is known from the data on test steels No. 15 to 19 that an excessive C content deteriorates magnetic characteristic considerably.

The respective Mn contents of steels Nos. 20 and 21 are out side the Mn content range specified by the present invention. The machinability (antiburring property) of steels is satisfactory owing to precipitated fin MnS grains when the Mn content is not greater than 0.5% . Burrs of big height are formed and machinability is unsatisfactory when the steels have a Mn content below 0.1% . In a steel having a Mn content exceeding 0.5% , large MnS grains suppress the growth of ferrite grains, and precipitated MnS grains binds magnetic flux to deteriorate magnetic characteristic.

A test steel No. 22 has an excessively large P content. In the test steel No. 22, the segregation of Pin grain boundaries suppresses the growth of grains and, consequently, the-test steel No. 22 has an inferior magnetic characteristic. Test steels Nos. 23 to 25 have S contents outside the S content range specified by the present invention. Machinability is unsatisfactory when the S content is below 0.01% . Large MnS grains are formed and magnetic characteristic deteriorates when the S content is above 0.15% .

The effect of Al content is conspicuous in a test steel No. 26. Development of AlN suppresses the growth of gains and deteriorates magnetic characteristic remarkably.

The effects of N and O are conspicuous in test steels Nos. 27 and 28. Although N and O do not affect machinability significantly, N and O contained in inappropriate N and O contents affect adversely to magnetic characteristic.

The effects of Bi content arid Pb content is conspicuous in test steels Nos. 29 and 30. Excessively large Bi or Pb contents deteriorate magnetic characteristic.

The effect of B content is conspicuous in a test steel No. 31. Boron does not exhibit any bad effect when the B content is below the lower B content limit specified by the present invention. If the B content exceeds the upper B content limit specified by the present Invention, a large amount of BN precipitates to deteriorate magnetic characteristic.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A soft magnetic low-carbon steel having a chemical composition having a C content of 0.05% by mass or below, a Si content of 0.1% by mass or below, a Mn content in the range of 0.10 to 0.50% by mass, a P content of 0.030% by mass or below, a S content in the range of 0.010 to 0.15% by mass, an Al content of 0.01% by mass or below, a N content of 0.005% by mass or below, and an O content of 0.02% by mass or below; and wherein Mn/S mass ratio is 3.0 or above, ferrite grain size is 100 μm or above, ferrite grains contain precipitated MnS grains of grain sizes of 0.2 μm or above in a density in the density range of 0.02 to 0.5 grains/$\mu m^2$, and the precipitated MnS grains have a mean grain size in the range of 0.05 to 4 μm.

2. The soft magnetic low-carbon steel according to claim 1, further containing at least one of Bi in a Bi content in the range of 0.005 to 0.05% by mass and Pb in a Pb content in the range of 0.01 to 0.1% by mass.

3. The soft magnetic low-carbon steel according to claim 1, further containing B in a B content in the range of 0.0005 to 0.005% by mass.

4. A method of manufacturing a soft magnetic low-carbon steel, the method comprising the steps of:

heating a soft magnetic low-carbon steel having a chemical composition having a C content of 0.05% by mass or below, a Si content of 0.1% by mass or below, a Mn content in the range of 0.10 to 0.50% by mass, a P content of 0.030% by mass or below, a S content in the range of 0.010 to 0.15% by mass, an Al content of 0.01% by mass or below, a N content of 0.005% by mass or below, and an O content of 0.02% by mass or below at a temperature in the range of 1000° C. to 1200° C. and hot-rolling the heated soft magnetic low-carbon steel in a steel sheet;

finish rolling the hot-rolled steel sheet at a finishing temperature of 850° C. or above, and cooling the finish-rolled steel sheet in the range of 800° C. to 500° C. at a mean cooling rate in the range of 0.5 to 10° C./s; and producing the steel of claim 1.

5. A method of using soft magnetic low-carbon steel, the method comprising the steps of:

forming a workpiece by subjecting the steel of claim 1 to cold forging and machining; and subjecting the workpiece to annealing at a temperature in the range of 850° C. to 950° C. for 3 hr or longer.

* * * * *

UNITED STATES PATENT AND TRADEMARK OFFICE

CERTIFICATE OF CORRECTION

PATENT NO. : 7,267,729 B2
APPLICATION NO. : 10/737764
DATED : September 11, 2007
INVENTOR(S) : Chiba et al.

It is certified that error appears in the above-identified patent and that said Letters Patent is hereby corrected as shown below:

On the title page, Item (73), the Assignee is incorrect. Item (73) should read:

-- (73) Assignee: Kabushiki Kaisha Kobe Seiko Sho (Kobe Steel, Ltd.), Kobe-shi, (JP) --

Signed and Sealed this

Twentieth Day of November, 2007

JON W. DUDAS
*Director of the United States Patent and Trademark Office*